US005518037A

United States Patent [19]

Takahashi et al.

[11] Patent Number: 5,518,037

[45] Date of Patent: May 21, 1996

[54] CLOTH FELL DISPLACEMENT IN A TERRY LOOM

[75] Inventors: Nobuyuki Takahashi; Yoshimi Iwano; Masao Shiraki; Hajime Suzuki, all of Kariya; Kojiro Miyake, Nishikasugai, all of Japan

[73] Assignee: Kabushiki Kaisha Toyoda Jidoshokki Seisakusho, Kariya, Japan

[21] Appl. No.: 303,949

[22] Filed: Sep. 9, 1994

[30] Foreign Application Priority Data

Sep. 13, 1993 [JP] Japan ..... 5-227480
Sep. 29, 1993 [JP] Japan ..... 5-243198

[51] Int. Cl.[6] ..... D03D 49/10; D03D 39/22

[52] U.S. Cl. ..... 139/25; 139/1 C; 139/26

[58] Field of Search ..... 139/25, 1 C, 102, 139/26

[56] References Cited

U.S. PATENT DOCUMENTS

| | | | |
|---|---|---|---|
| 3,739,817 | 6/1973 | Kunz | 139/25 |
| 4,293,006 | 10/1981 | Peter | 139/25 X |
| 5,014,756 | 5/1991 | Vogel et al. | 139/102 X |
| 5,058,628 | 10/1991 | Spiller et al. | 139/25 |

FOREIGN PATENT DOCUMENTS

| | | |
|---|---|---|
| 0350446 | 1/1990 | European Pat. Off. . |
| 56-73141 | 6/1981 | Japan . |
| 247337 | 2/1990 | Japan . |
| 247334 | 2/1990 | Japan . |
| 21540296 | 6/1990 | Japan . |
| 5156546 | 6/1993 | Japan . |

*Primary Examiner*—Andy Falik
*Attorney, Agent, or Firm*—Brooks Haidt Haffner & Delahunty

[57] ABSTRACT

A pile forming apparatus allowing use of a driving motor of small capacity for effectuating terry motion while assuring high quality for manufactured pile fabric includes a ball screw constituting an output shaft of the driving motor with which driven nuts threadedly engage. One driven nut is operatively connected to a first arm of a displacement-direction change-over lever by a link. Displacement of the driven nuts caused by rotation of the ball screw is transmitted to an expansion bar via the link, the change-over lever, a first rod, an intermediate lever, a second rod and a supporting lever to displace the cloth fell of the pile woven fabric.

17 Claims, 7 Drawing Sheets

CLOTH FELL DISPLACEMENT IN A TERRY LOOM

BACKGROUND OF THE INVENTION

1. Field of the Invention

The present invention relates to a pile forming method and apparatus for a pile fabric weaving machine in which piles are formed by changing the relative distance between the reed beating position and the cloth fell of woven fabric.

2. Description of the Prior Art

As a method of forming piles by changing the relative distance between the reed beating position and the cloth fell of woven fabric, there are mentioned a method of changing the reed beating position and a method of changing the cloth fell by shifting or displacing the path along which the fabric is moved (hereinafter referred to as the cloth path). In Japanese Unexamined Patent Application Publications Nos. 73141/1981, 47337/1990 and 156546/1993 (JP-A-56-73141, JP-A-H2-47337 and JP-A-H5-156546), there is disclosed a pile fabric weaving machine in which the cloth fell position is changed by displacing the cloth path.

In the case of the pile fabric weaving machine disclosed in JP-A-H2-47337, a worm wheel portion is formed in a supporting lever on which an expansion bar is supported, wherein a worm mounted fixedly on an output shaft of a servo motor meshes with the worm wheel portion. Through forward/backward rotations of the servo motor, the expansion bar is swingably displaced, whereby the cloth fell position is changed.

However, there exists inevitably a backlash between the worm and the worm wheel, as a result of which a large sliding load acts between the worm and the worm wheel upon changing-over of the rotating direction of the servo motor between the forward direction and the backward or reverse direction. Owing to this sliding load, there is friction between the worm and the worm wheel, which friction tends to further increase the backlash between the worm and the worm wheel. As a result of this, the position of the expansion bar deviates from the normal positions predetermined for a fast pick operation and a loose pick operation, respectively. More specifically, in the fast pick operation phase, the cloth fell position is displaced in the direction in which the beating force of the reed increases, while in the loose pick operation phase, the cloth fell position is displaced in the direction in which the distance between the cloth fell position and the reed beating position increases. When these displacements occur, the beating force of the reed becomes excessively large and the amount of terry consumed for the formation of the piles changes or increases. It goes without saying that an excessively large beating force of the reed and variation in the amount of terry exert adverse influence upon the formation of piles, incurring degradation in the quality of the pile fabric as manufactured.

Further, because of the large sliding load mentioned above, efficiency in the transmission of driving power between the worm and the worm wheel is degraded, involving a large load applied to the servo motor. Under the circumstances, an electric motor of a large capacity has to be employed as the servo motor, which is of course undesirable not only from the economical viewpoint but also in the respect that a large space is required for installation. On the other hand, in the case of the pile fabric weaving machine disclosed in JP-A-56-73141 mentioned above, a surface roller constituting one of the members which form or define the cloth path is arranged to be switchably driven by a terry motion mechanism, whereas in the case of the pile fabric weaving machine disclosed in JP-A-H5-156546, an expansion bar constituting one of the cloth path defining members is switchably driven by a terry motion mechanism.

It is self-explanatory that the conditions for the pile formation exert great influence upon the quality of the pile fabric manufactured by the pile fabric weaving machine. In the case where the piles are to be formed only to one surface of the fabric, there may occur such a pile dropout event that a pile is formed on the other surface of the fabric. Certainly, in the pile fabric weaving machines disclosed in JP-A-56-73141 and JP-A-H5-156546, the pile length can be changed in the course of the weaving operation. However. in these prior art machines, it is noted that no measures are taken concerning the pile formation on which the quality of the pile fabric has great dependency.

SUMMARY OF THE INVENTION

In the light of the state of the art described above, it is an object of the present invention to provide a pile forming apparatus for a pile fabric weaving machine which apparatus allows a driving motor of small capacity to be employed for effectuating the terry motion while preventing the quality of the pile fabric as woven from degradation.

Another object of the present invention is to provide a pile forming method which is capable of suppressing pile dropout in the course of formation of piles on one surface of a fabric in the pile forming apparatus mentioned above.

In view of the above and other objects which will become apparent as the description proceeds, there is provided according to an aspect of the present invention a pile forming apparatus which includes a ball screw mechanism for disposing driven members which engage screwwise with a ball screw switchably to a terry-zero position and a terry-available position by rotating the ball screw, a terry motion member for changing the relative distance between the beating position of a reed and the cloth fell of a woven fabric in step with the displacement of the driven members, and a driving motor for rotationally driving the ball screw reciprocatively.

In a mode for carrying out the invention, the ball screw should preferably be covered with a flexible or collapsible cover which undergoes contraction and expansion upon displacements of the driven members.

The terry motion member may be constituted by an expansion bar which serves to define a cloth path or alternatively by a reed, wherein the terry motion displacement of the driven member is transmitted to the terry motion member. Because balls are interposed between the ball screw and the driven member, a sliding load is not present but only a rolling load of small magnitude acts between the ball screw and the driven members. Consequently, the ball screw, the balls and the driven member are protected against abrasion, which in turn means that the terry motion member is protected against deviations from the normal positions in both the fast pick operation phase and the loose pick operation phase. Further, efficiency in transmission of the driving power between the ball screw and the driven member is increased, which in turn means that the capacity of the driving motor can correspondingly be reduced.

By covering the ball screw with a flexible cover, adhesion or deposition of fly waste on the ball screw is prevented, whereby lowering of the driving power transmission efficiency due to the deposition of fly waste is avoided.

Furthermore, in view of the object of the invention mentioned hereinbefore, there is provided according to another aspect of the present invention a pile forming method according to which the amount of terry in a second loose pick operation phase is made greater than the amount of terry in a first loose pick operation, for thereby forming the piles only on one surface of the fabric. To say it in another way, in the pile forming method according to the invention for forming piles only on one surface of the fabric, the amount of terry in a first loose pick operation phase is so set as to differ slightly from that in a second loose pick operation. More specifically, the relative distance between the beating position of the reed and the cloth fell position in the second loose pick operation phase is set greater than the sum of the distance between the reed beating position and the cloth fell position and the displacement of the cloth fell corresponding to one cycle of the weft beating operation. Owing to the presence of a difference in the amount of terry as mentioned above, the pile dropout defect can positively be suppressed in the operation for forming the piles on one surface of a fabric.

In a mode for carrying out the pile forming method in the pile forming apparatus described above, the terry motion member may be so arranged as to dispose or shift switchably the cloth path defining member to the cloth path defining position for the fast pick operation, a first cloth path displacement position at which the amount of terry for the first loose pick operation is available and a second cloth path displacement position where the amount of terry for the second loose pick operation is available.

These and other advantages and attainments of the present invention will become apparent to those skilled in the art upon a reading of the following detailed description when taken in conjunction with the drawings, wherein there is shown and described an illustrative embodiments of the invention.

BRIEF DESCRIPTION OF THE DRAWINGS

In the course of the following detailed description, reference will be made to the attached drawings in which:

FIG. 8(*b*) is an enlarged sectional view for illustrating a formation of the piles in another operation phase;

DESCRIPTION OF THE PREFERRED EMBODIMENTS

Now, the present invention will be described in detail in conjunction with preferred or exemplary embodiments thereof by reference to the drawings, in which like or equivalent parts are denoted by the same or like reference symbols throughout the several figures. Further, in the following description, it is to be understood that such terms as "left", "right", "front", "rear", "forward", "backward", and the like are words of convenience and are not to be construed as limiting terms.

Figure 1:
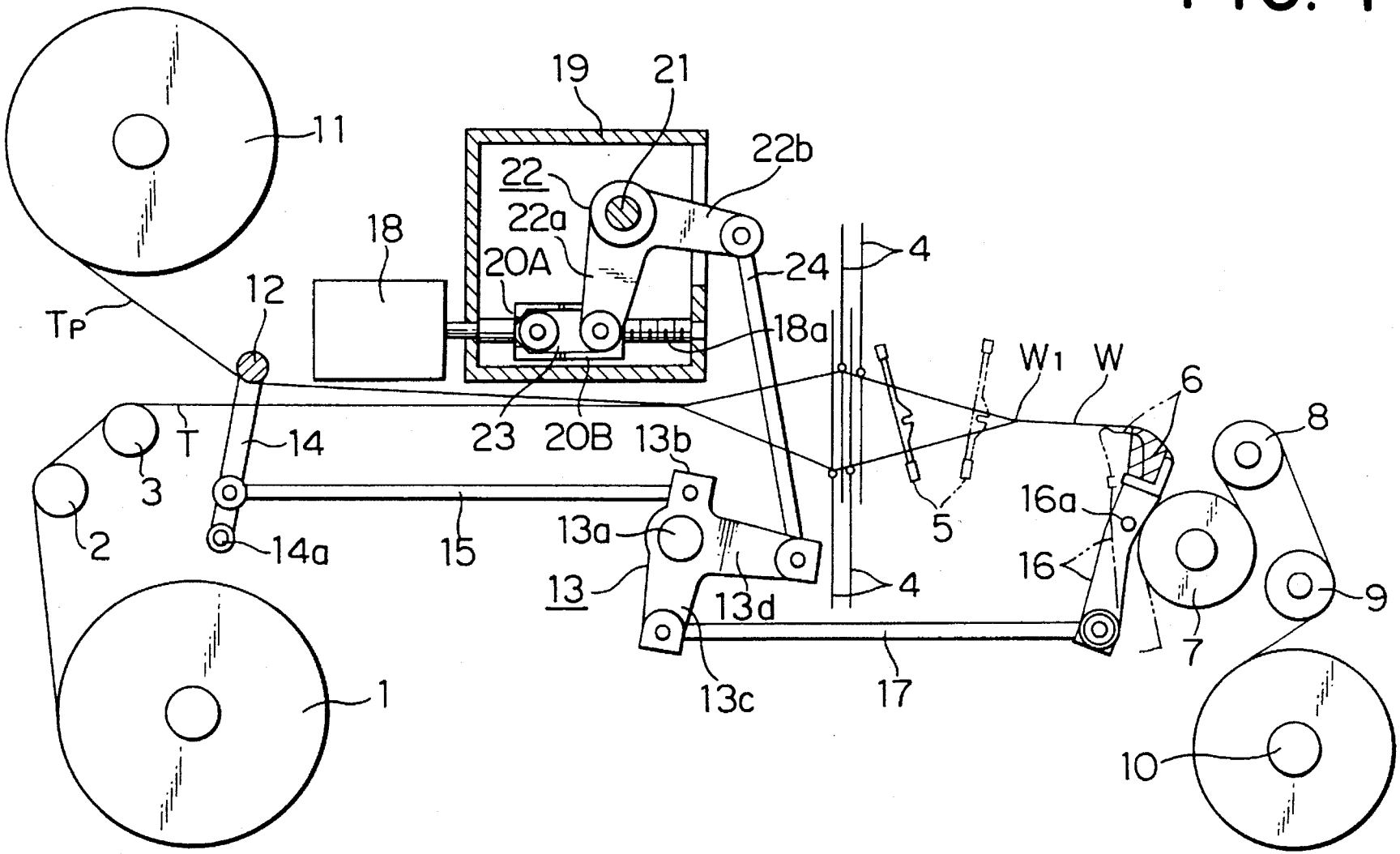
FIG. 1 is a side view showing generally and schematically the structure of a weaving machine to which the teachings of the invention are applied.

Referring to the drawings and particularly to FIG. 1 which shows schematically in a side elevational view a whole structure of a weaving machine according to a preferred embodiment of the invention, the reference numeral 1 denotes a ground-destined warp beam (also referred to as the yarn beam) from which the ground-destined warps T (i.e., the warps for weaving the ground texture) are delivered to the weaving machine upon actuation of a feeding motor (not shown) provided in association with the ground-destined warp beam 1. More specifically, the ground-destined warps T as delivered from the ground-destined warp beam 1 are so guided as to extend through a heald 4 and a modified reed 5 via a back roller 2 and a tension roller 3. A woven fabric W is taken up or wound around a cloth roller 10 by way of an expansion bar 6 constituting a terry motion member, a surface roller 7 and guide rollers 8 and 9.

Disposed above the ground-destined warp beam 1 is a pile-destined warp beam 11. The pile-destined warps (i.e., the warps for forming piles) Tp delivered from the pile-destined warp beam 11 when an associated feed motor (not shown) is operated are guided into the heald 4 and the modified reed 5 via a tension roller 12.

Disposed substantially at a center position of the weaving machine as viewed in the direction perpendicular to the plane of the drawing is an intermediate lever 13 of trifurcated shape which is rotatably or pivotally mounted on a supporting shaft 13*a*. On the other hand, at a rear end portion of the weaving machine, a supporting lever 14 is disposed, being mounted rotatably on a supporting shaft 14*a*. The tension roller 12 mentioned previously is supported on the supporting lever 14. The supporting lever 14 and a first arm 13*b* of the intermediate lever 13 are mutually linked by means of a rod 15. Further disposed at a front side of the weaving machine is a supporting lever 16 which is rotatably mounted on a supporting shaft 16*a*. The expansion bar 6 mentioned previously is supported on the supporting lever 16, wherein the supporting lever 16 and a second arm 13*c* of the trifurcated intermediate lever 13 are interlinked by means of a rod 17. Thus, upon rotation of the trifurcated intermediate lever 13, the supporting lever(s) 14 and 16 are caused to rotate or swing in the same direction, whereby the tension roller 12 and the expansion bar 6 are displaced by the same distance in the same direction, which in turn results in displacement of the routes or paths followed by the pile-destined warps Tp as well as displacement of the route or path (hereinafter referred to as the cloth path) for the woven fabric W. Thus, the cloth fell W1 of the woven fabric W is also positionally displaced.

Figure 2:
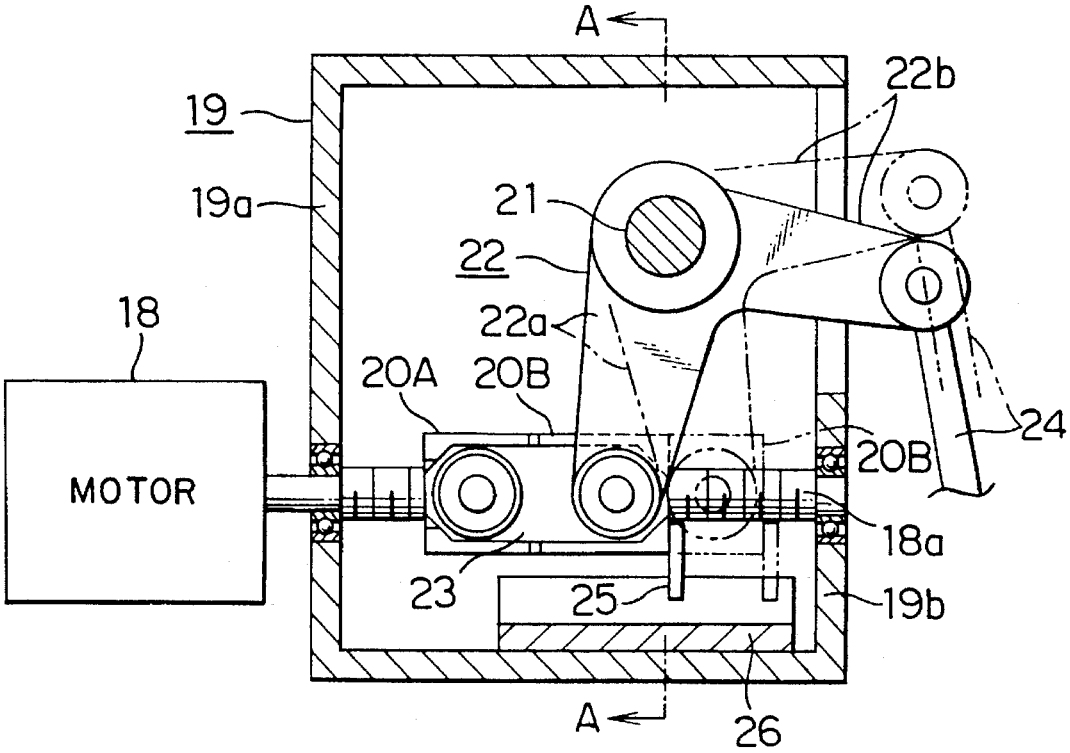
FIG. 2 is an enlarged side view showing partially in section a ball screw mechanism employed in the weaving machine of FIG. 1.

As can be seen in FIGS. 1 and 2, a servo motor 18 is disposed above the trifurcated intermediate lever 13. The servo motor 18 has an output shaft implemented in the form of a ball screw 18*a* which extends into a supporting box 19 through a rear wall 19*a* thereof. Thus, the ball screw 18*a* is rotatably supported between the rear wall 19*a* and a front wall 19*b* of the supporting box 19. A pair of driven nut members 20A and 20B engage screw-wise with the ball screw 18*a* through the medium of balls (not shown). Both of the driven nut members 20A and 20B are constantly urged toward each other by a clamping mechanism (not shown). More specifically, both the driven nut members 20A and 20B are placed in threadwise or screw-wise engagement with the ball screw 18*a* under a preload so that upon rotation of the ball screw 18*a* in the forward or reverse direction, the driven nut members 20A and 20Bare caused to move screw-wise in unison along the ball screw 18*a* in one or other direction without being accompanied with any appreciable backlash.

Figure 4:
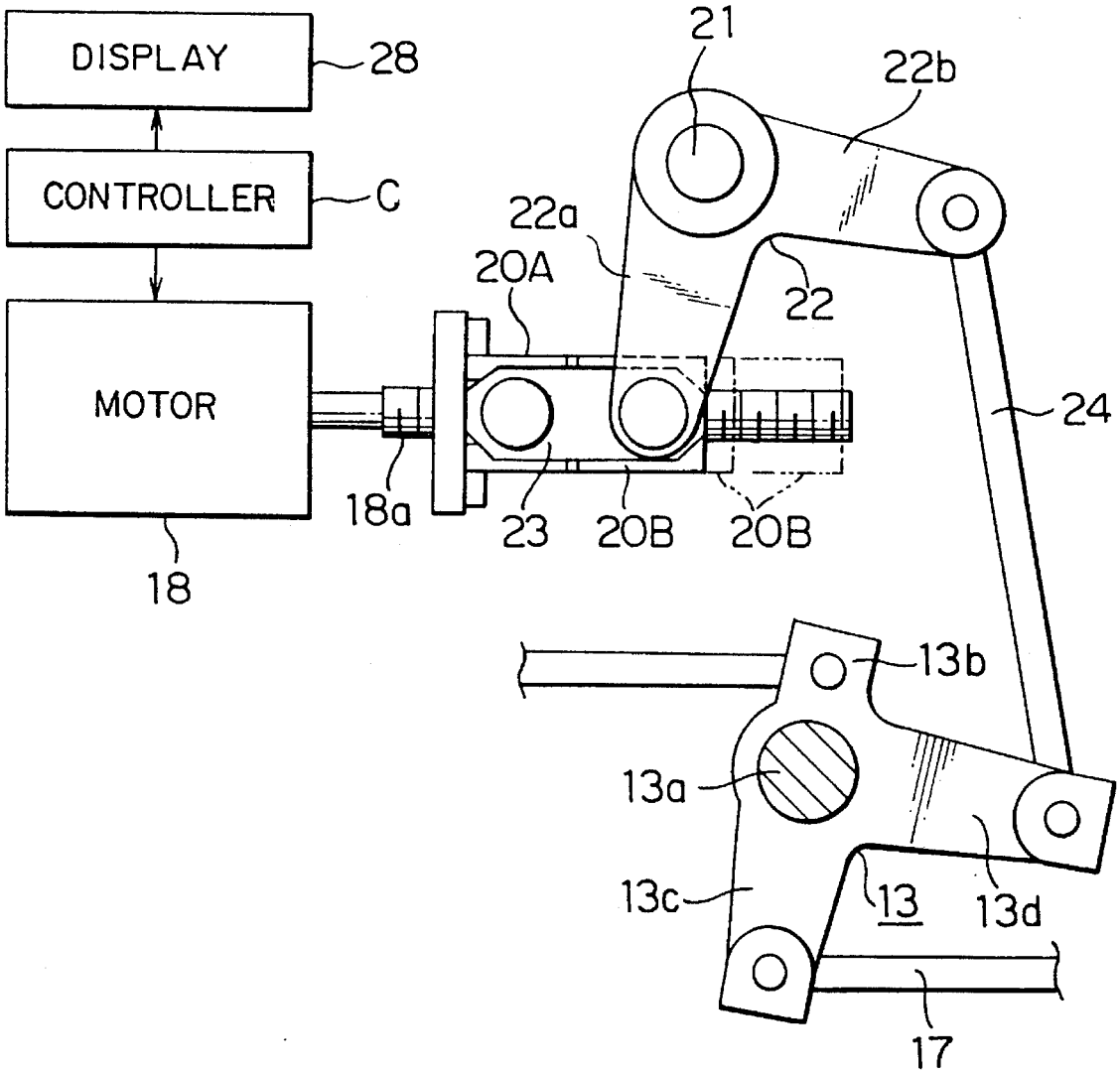
FIG. 4 is an enlarged sectional view showing a terry motion member used in the weaving machine according to an embodiment of the invention.

The servo motor 18 is under the control of a control computer i.e., a computerized controller C (see FIG. 4). In other words, the control computer C controls the servo motor 18 in accordance with a pile fabric weaving pattern. The driven nut members 20A and 20B are moved between a terry-zero position (i.e., zero terry position) indicated by phantom lines in FIG. 2 and a terry-available position (i.e., non-zero terry position) indicated by a solid line in response to the rotation of the ball screw 18*a*. More specifically, in the fast pick operation phase, the driven nut members 20A and 20B are disposed at the terry-zero position, while they are disposed at the terry-available position in loose pick operation phases, as will be described hereinafter.

A slider 25 is fixedly secured to the driven nut member 20B, while a guide member 26 is secured to a bottom wall of the supporting box 19, wherein the slider 25, which is caused to move together with the driven nut member 20B, and hence the driven nut member 20A are guided by the guide member 26. By virtue of this guide arrangement, the driven nut members 20A and 20B are prevented from spontaneous rotation.

At this juncture, it should be mentioned that implementation of the guide member 26 for guiding the slider 25 in the form of a roller-type guide structure is preferred because seizure of the slider 25 is then prevented.

Figure 3:
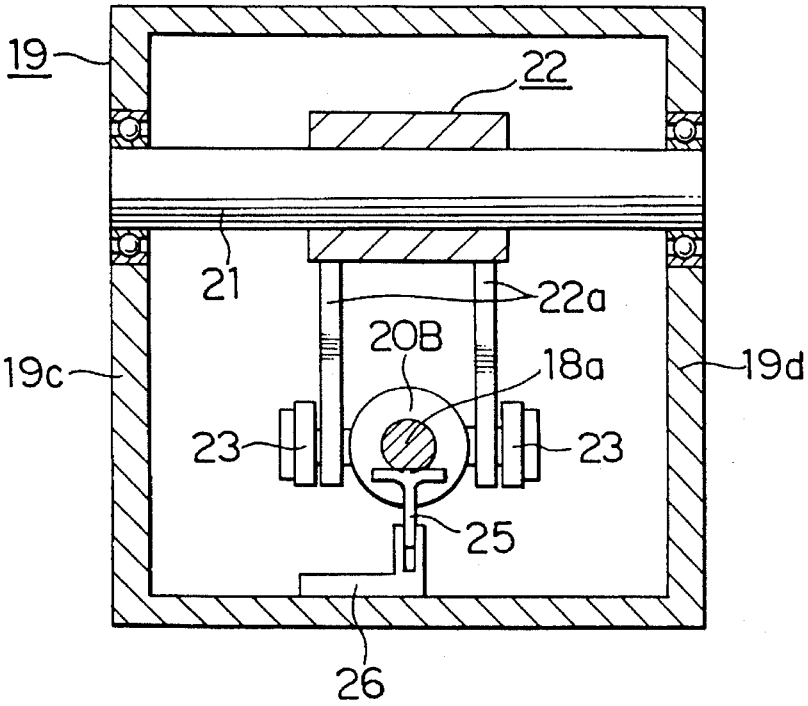
FIG. 3 is a sectional view taken along a line A—A in FIG. 2.

As is shown in FIG. 3, a supporting shaft 21 is rotatably suspended between both side walls 19*c* and 19*d* of the supporting box 19. Further, a displacement-direction switching lever 22 of a bifurcated configuration is supported on the supporting shaft 21, as can be seen in FIG. 2. A first arm 22*a* of the bifurcated displacement-direction switching lever 22 and the driven nut member 20A are mutually coupled by means of a link 23. Besides, a second arm 22*b* of the bifurcated displacement-direction switching lever 22 is linked to a third arm 13*d* of the trifurcated intermediate lever 13 by means of a rod 24. Thus, reciprocative displacements of the driven nut members 20A and 20B as brought about by forward and reverse rotations of the ball screw 18*a* are transmitted to the expansion bar 6 via a displacement transmission mechanism which is constituted by the link 23, the bifurcated displacement-direction switching lever 22, the rod 24, the trifurcated intermediate lever 13, the rod 17 and the supporting lever 16, whereby the expansion bar 6 is caused to rotate in the corresponding direction around the supporting shaft 16*a*. In this conjunction, it is to be noted that the bifurcated displacement-direction switching lever 22 assumes a position indicated by phantom lines in FIG. 2 when the driven nut members 20A and 20B are at the terry-zero position with the expansion bar 6 being disposed at a position indicated by phantom lines in FIG. 1. On the other hand, when the driven nut members 20A and 20B are at the terry-available position (non-zero terry position), the bifurcated displacement-direction switching lever 22 assumes a position indicated by solid lines in FIG. 2, whereby the expansion bar 6 is disposed at a position indicated by solid lines in FIG. 1.

Parenthetically, it should be mentioned that temple means (not shown) for preventing shrinkage (crepe) of the woven fabric W in the direction widthwise thereof as well as a fell plate (not shown either) for preventing lowering of the fabric in the vicinity of the cloth fell W1 are so arranged as to follow the displacement of the expansion bar 6. Further, the reciprocative displacement of the driven nut members 20A and 20B is transmitted to the tension roller 12 via the trifurcated intermediate lever 13 and the rod 15.

At this juncture, it should also be noted that the sliding load such as observed in a worm mechanism is absent between the ball screw 18*a* and the driven nut members 20A and 20B, and they are only subjected to a rolling load which is remarkably smaller than the sliding load. Thus, the efficiency of driving power transmission from the ball screw 18*a* to the driven nut members 20A and 20B is significantly enhanced when compared with that of the worm mechanism. For this reason, an inexpensive electric motor of small capacity can be employed as the servo motor 18, which thus provides an advantage in respect to the cost over the prior art machine in which the worm mechanism is employed. Besides, any appreciable friction can not occur among the ball screw 18*a*, the balls thereof and the driven nut members 20A and 20B because only a rolling load of small magnitude is effective. Furthermore, since a preload is applied to the driven nut members 20A and 20B against the ball screw 18*a*, very high accuracy or precision can be achieved for positioning or indexing the driven nut members 20A and 20B to the predetermined terry-zero position and the terry-available position, respectively. This means that deviation is substantially zero. In other words, the expansion bar 6 can be indexed to predetermined positions with extremely high accuracy or precision in either the fast-pick operation phase or the loose-pick operation phase. This in turn means that the cloth fell W1 is always indexed to the normal position with very high accuracy or precision upon beating in either the fast-pick operation phase or the loose-pick operation phase. In this manner, reed beating can always be realized with the most appropriate magnitude of the beating force, whereby a desired amount of terry can be assured. Thus, the quality of the pile fabric as finished can be significantly improved.

Further, because the amount of displacements of the driven nut members 20A and 20B can be steplessly adjusted, the amount of terry can also be regulated continuously, whereby piles of a desired length can be formed arbitrarily.

Figure 5:
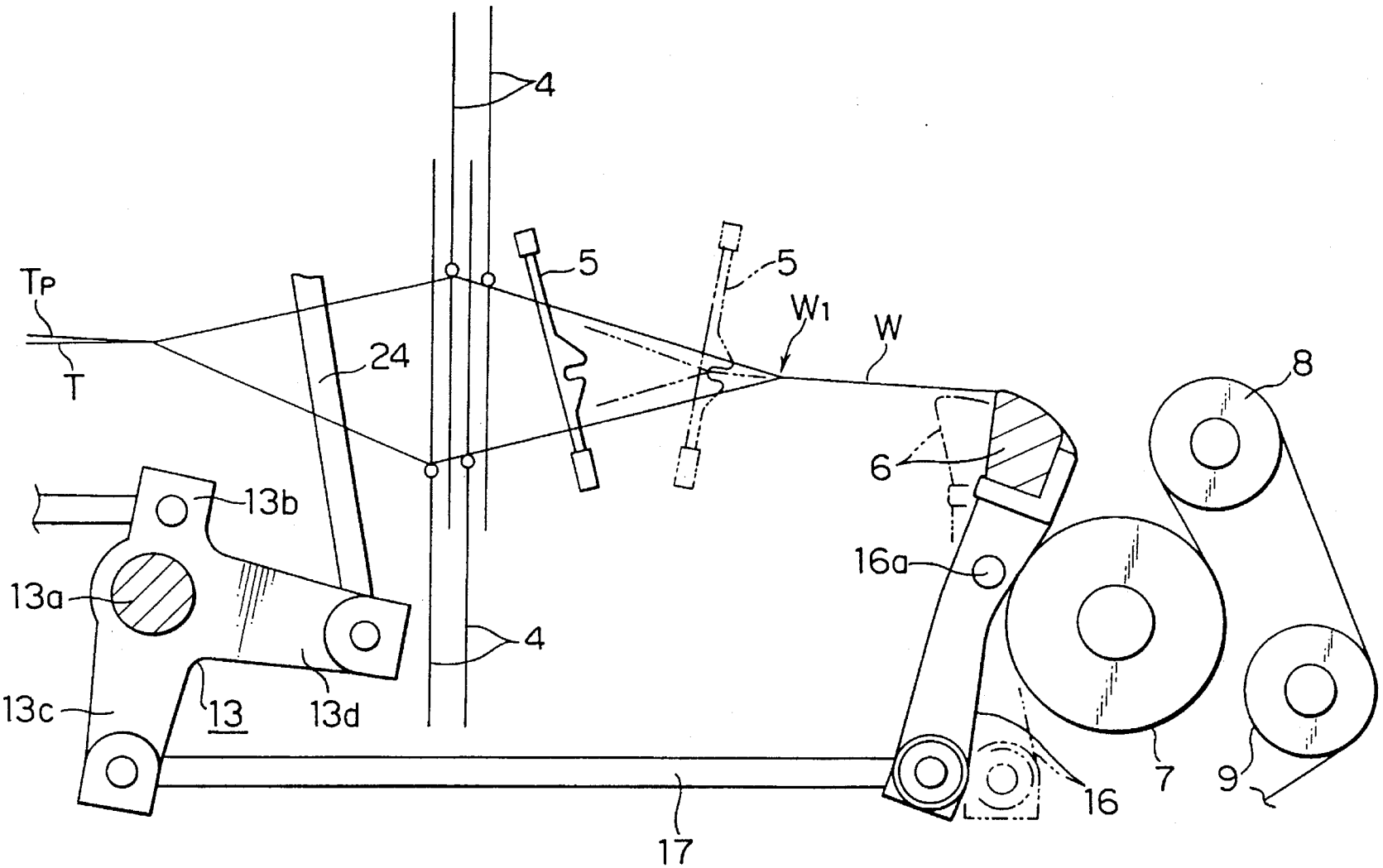
FIG. 5 is an enlarged sectional view showing an expansion bar in the state of a first loose pick operation.
Figure 6:
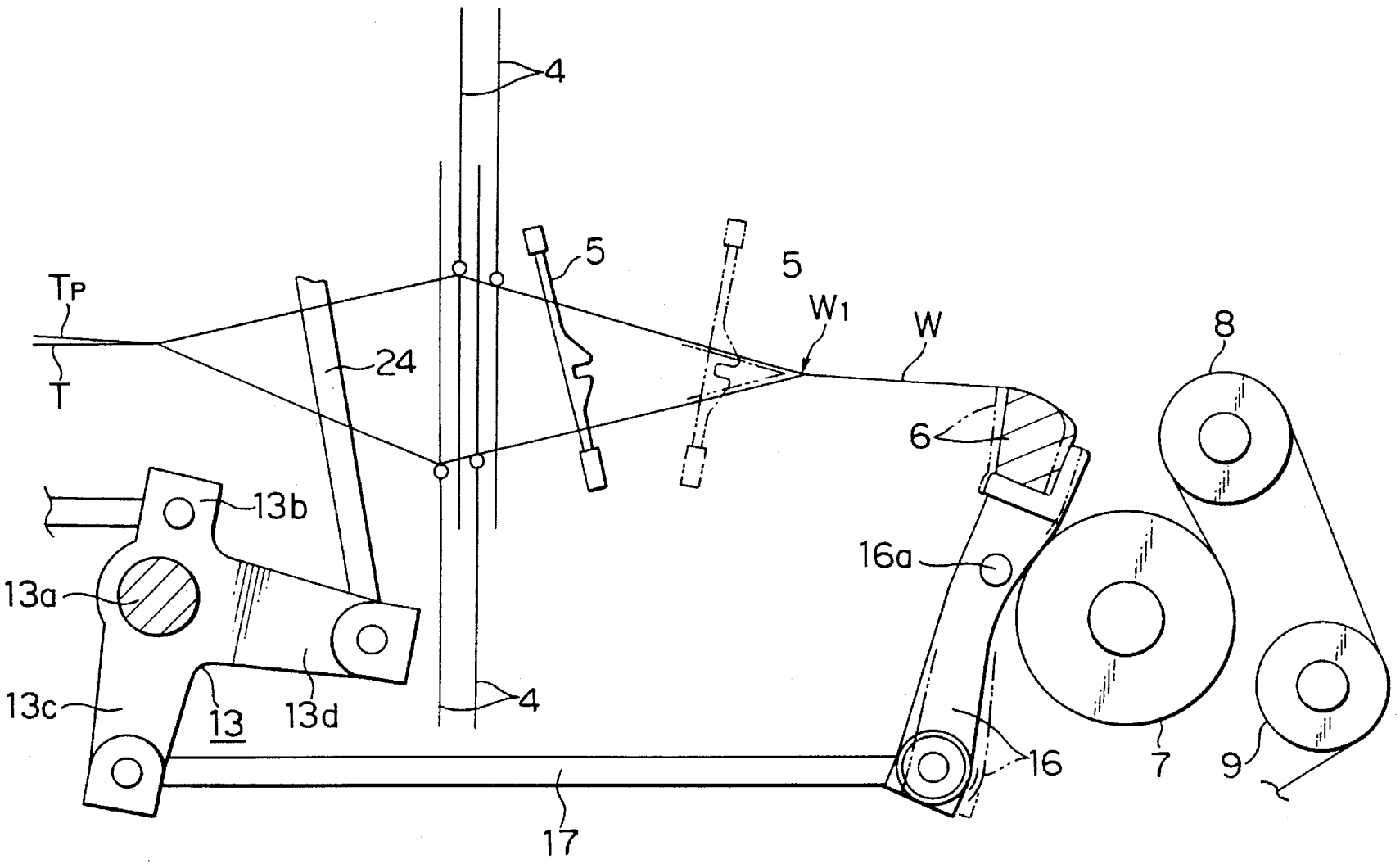
FIG. 6 is an enlarged sectional view showing the expansion bar in a second loose pick operation phase.
Figure 7:
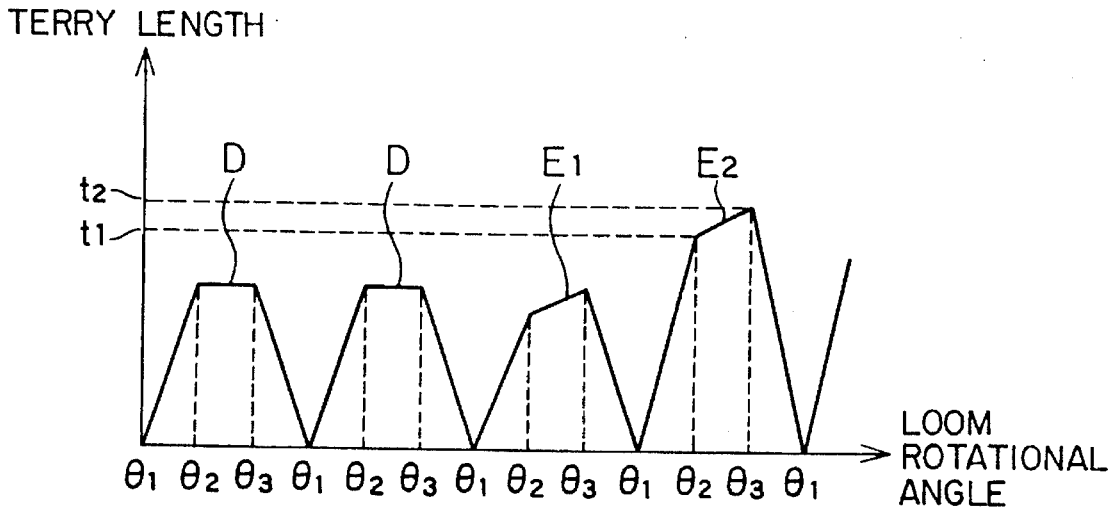
FIG. 7 is a view for graphically illustrating change in the amount of terry.

As shown in FIG. 4, the servo motor 18 is under the control of the control computer C. More specifically, the control computer C controls operation of the servo motor 18 on the basis of a pile weaving pattern. FIG. 7 illustrates graphically the change in the amount of terry for a three-weft towel texture. Referring to FIG. 7, loom frame rotation angles 01, 02 and 03 represent beating time points or timing, wherein these angles 01, 02 and 03 are of the same value, i.e., 1=2=3. A curve D represents a change in the amount of terry in the case of formation of three-weft towel textures at both surfaces while each of the curves E1 and E2 represents changes in the amount of terry in the case of formation of a three-weft towel texture at one surface, respectively. At the beating time point 01, the expansion bar 6 is at a position shown in phantom in FIGS. 1 and 5. At the beating time point 02, the expansion bar 6 assumes a first cloth path displacing position indicated by solid lines in FIGS. 1 and 5 and shown in phantom in FIG. 6. At the beating time point 03, the expansion bar 6 is set to a second cloth path displacing position indicated by solid lines in FIG. 6.

The control computer or controller C displays on a display unit 28 the pick state, i.e., the fast pick operation phase, the first loose pick operation phase or the second loose pick operation phase, and the amount of terry.

Figure 8A:
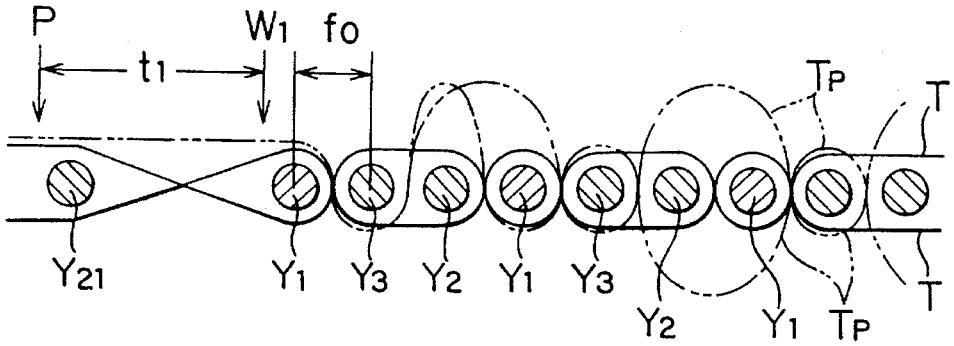
FIG. 8(*a*) is an enlarged sectional view for illustrating formation of piles.
Figure 8B:
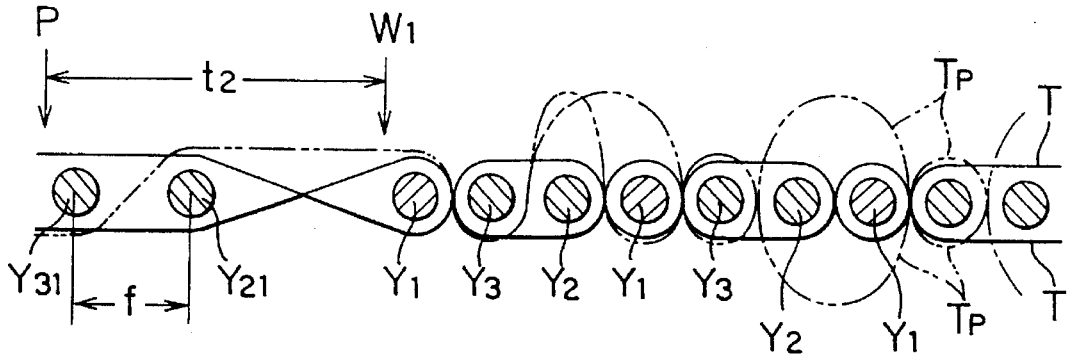

FIGS. 8(*a*) and 8(*b*) are views for illustrating pile formations for three-weft towel textures. In the figures, a reference symbol Y1 designates a weft beaten at the beating time point 01. Hereinafter, this weft Y1 will be referred to as the fast-picked weft. Upon beating of the fast picked weft Y1, both the driven nut member 20A and the driven nut member 20B are at the terry-zero position shown in phantom in FIGS. 2 and 4. At this position, the cloth fell W1 and the beating position P coincide with each other, as indicated in phantom in FIG. 5. Reference symbols Y2 and Y21 designate the wefts beaten at the beating time point 02. These wefts will hereinafter be referred to as the loosely picked weft. Further, symbols Y3 and Y31 designate the wefts beaten at the beating time point 03. Hereinafter, these wefts will be referred to as the second loosely picked wefts. At the beating time points for the first loosely picked weft Y2 and Y21 and the second loosely picked weft Y3 and Y31, respectively, the driven nut members 20A and 20B assume the terry-available positions indicated by the broken lines in FIGS. 2 and 4.

The distance t1 between the beating position P for the first loosely picked weft Y21 and the woven fabric W1 (this distance equivalently represents the amount of terry) is selected slightly shorter than the distance t2 between the beating position P for the second loosely picked weft Y31 and the cloth fell W1. The amount of terry can be changed in this manner by operating correspondingly the servo motor 18 as described hereinbefore by reference to FIG. 4.

When the difference between the terry amount t1 at the first loose pick operation and the terry amount t2 at the second loose pick operation is zero, the distance between the first loosely picked weft Y21 and the second loosely picked weft Y31 is substantially equal to the displacement of the cloth fell W1 in one cycle of the usual weft beating, as indicated by f0 in FIG. 8(*a*). Consequently, when the fast picked weft Y1 is beaten, the fast picked weft Y1 will easily rise up above the second loosely picked weft Y31. This rise-up phenomenon is based on such a path or route arrangement that the pile-destined warps Tp first extend above the second loosely picked weft Y31 and then pass below the fast picked weft Y1. In the operation for forming the piles on both surfaces, the difference between the terry amounts t1 and t2 is zero and thus the distance between the first loosely picked weft Y2 and the second loosely picked weft Y3 is substantially equal to the distance f0. However, due to such a route or path arrangement that the fast picked weft Y1 is sandwiched between the upper and lower pile-destined warps T0, the aforementioned rise-up phenomenon of the fast picked weft Y1 does not take place. When the fast picked weft Y1 rises up above the second loosely picked weft Y31, the pile forming portions of the pile-destined warps Tp tend to be urged or pressed downwardly, as a result of which the pile dropout phenomenon takes place with the pile being formed on the rear surface of the woven fabric W.

Presence of the difference between the terry amounts t1 and t2 (i.e., $t2-t1>0$) upon pile formation on one surface increases the distance f between the second loosely picked weft Y31 and the first loosely picked weft Y21 (see FIG. 8(*b*)) when compared with the corresponding distance f0 in the formation of the piles on both surfaces. In the formation of the piles on one surface, the phenomenon that the second loosely picked weft Y31 rises up above the first loosely picked weft Y21 can be prevented by setting the distance f greater than the distance f0 set in the case of pile formation on both surfaces. Consequently, the push-down of the pile forming portions of the pile-destined warps Tp can be avoided, whereby the pile dropout defect can be prevented.

More specifically, when the weft is beaten in the fast pick operation phase, the driven nut members 20A and 20B lie at a right-hand position indicated in phantom in FIG. 4, wherein the terry amount is zero. When the weft is beaten in the first loose pick operation phase, the driven nut members 20A and 20B are located at a left-hand position also indicated in phantom in FIG. 4, while the driven nut members 20A and 20B assume the position indicated by the solid line upon beating of the weft in the second loose pick operation phase. Thus, there exists a difference in the terry amount between the first loose pick operation and the second loose pick operation, whereby the dropout of piles is prevented.

Figure 9:
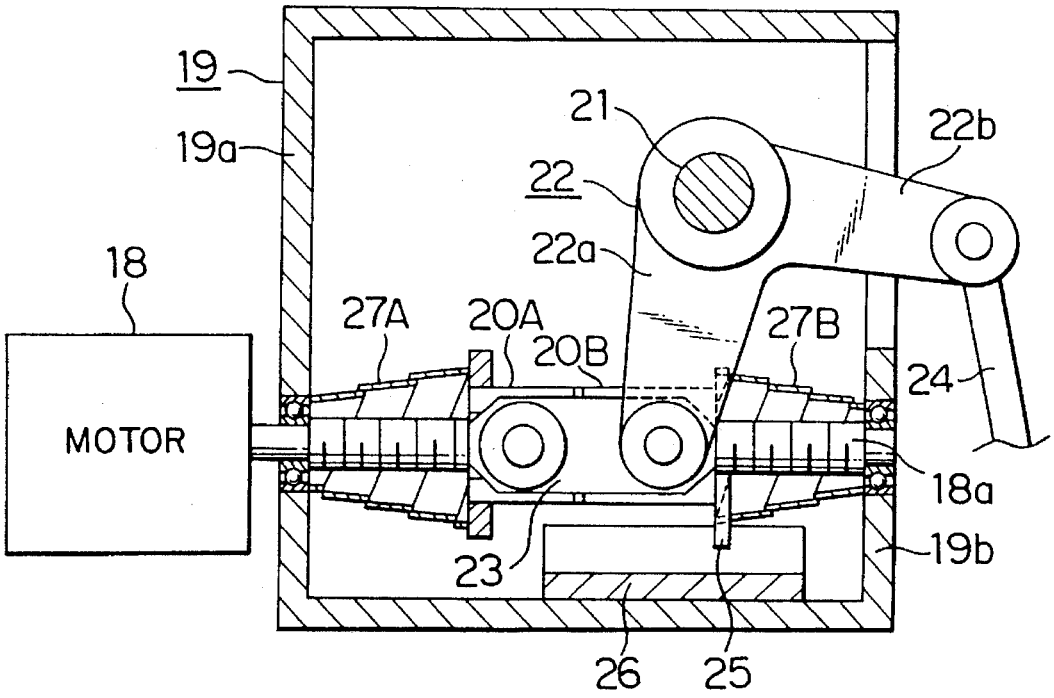
FIG. 9 is an enlarged elevational view showing partially in section a major portion of a weaving machine according to another embodiment of the invention.

Although the invention has been described in conjunction with the embodiment which is presently considered as being preferred, it goes without saying that the invention is never restricted to the illustrated embodiment but susceptible to many modifications or versions. By way of example, flexible covers 27A and 27B (FIG. 9) may be interposed between the driven nut member 20A and the rear wall 19*a* of the supporting box 19 and between the driven nut member 20B and the front wall 19*b* of the supporting box 19, respectively. These flexible covers 27A and 27B are contracted and expanded as the driven nut members 20A and 20B are moved reciprocatively, whereby the ball screw 18*a* is constantly covered with the flexible covers 27A and 27B. At this juncture, it can be readily understood that fly wastes deposited directly on the ball screw 18*a* will cut into or encroach between the ball screw 18*a* and the balls or between the balls and the driven nut members 20A and 20B. In that case, the rolling load will increase. The flexible covers 27A and 27B serve to protect the ball screw 18*a* against deposition or adhesion of fly waste to thereby prevent the rolling load from increasing.

Figure 10:
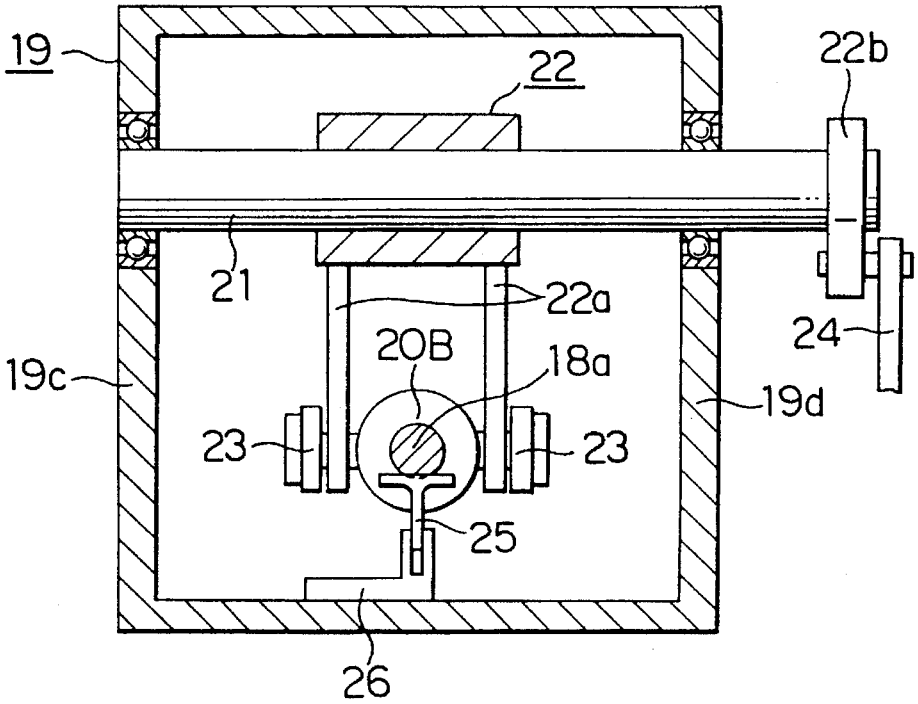
FIG. 10 is an enlarged elevational view showing partially in section a major portion of a weaving machine according to yet another embodiment of the invention.

Further, the supporting shaft 21 may be so arranged as to extend externally from the supporting box 19 which is sealed against the exterior, wherein the first arm 22*a* and the second arm 22*b* may be provided as separate members and fixedly mounted on the supporting shaft 21, as shown in FIG. 10. In this case, the exterior location of the arm 22*b* permits the supporting box 19 to be utilized as an oil bath container for lubricating the ball screw 18*a* and the slider 25 to thereby protect them against friction and/or jamming while preventing the fly waste from adhering to the driving mechanism disposed within the supporting box 19.

Besides, instead of the slide guide mechanism including the slider 25 for preventing spontaneous rotation of the driven nut members, there may be employed a spontaneous rotation preventing mechanism based on a rolling guide scheme. In this conjunction, it will be noted that if the driven nut members 20A and 20B can rotate spontaneously, the rotation will act on the bifurcated displacement-direction switching lever 22 in the direction longitudinally of the supporting shaft 21 to thereby present an obstacle to a smooth swinging motion of the bifurcated displacement-direction switching lever 22, whereby the driving power transmission efficiency is degraded. The driven nut anti-rotation mechanism is effective for preventing the driving power transmission efficiency from lowering. However, in the case of the slide-type anti-rotation mechanism, a sliding load becomes effective between the slider 25 and the guide member 26. In contrast, in the case of the rolling-type guide mechanism, the slider 25 and the guide member 26 are subjected to only a rolling load which is significantly smaller than a sliding load. Thus, the rolling-type guide mechanism is advantageous over the sliding-type guide mechanism in respect that high efficiency can be realized in the driving power or torque transmission.

Further, in another mode for carrying out the invention, the driven nut members may be mounted at both ends of the expansion bar so that the expansion bar is caused to linearly move reciprocatively in response to the forward/backward rotation of the ball screw to thereby effectuate the terry motion.

Besides, the teachings of the present invention can equally be applied to the pile fabric weaving machine of a beating position change-over type such as disclosed in, for example, Japanese Unexamined Patent Application Publication No. 47334/1990 (JP-A-H2-47334).

Furthermore, the weaving machine according to the illustrated embodiment of the invention may be so modified that the surface roller serving as the cloth path defining means can be changed over between a first cloth path shift position at which the terry is made available for the first loose pick operation and a second cloth path shift position at which the terry is made available for the second loose pick operation.

Accordingly, the teachings of the invention can also find application to a weaving machine of such a beating position shift type as disclosed in, for example, Japanese Unexamined Patent Application Publication No. 154029/1990 (JP-A-H2-154029). In that case, the distance between the beating position and the cloth fell in the second loose pick operation phase may be selected greater than that for the first loose pick operation.

As will now be appreciated from the foregoing description, by virtue of the inventive arrangement in which the driving power of the driving motor for effectuating the terry motion is transmitted to the terry motion member via the ball screw mechanism, an electric motor of a small capacity can be used as the driving motor without incurring any appreciable degradation in the quality of finished pile fabric or cloth.

Additionally, owing to such feature of the invention that in the formation of the piles only on one surface of the fabric, the amount of terry in the second loose pick operation phase is selected greater than that for the first loose pick operation, there can be achieved such advantageous effect that dropout of piles can positively be suppressed in the single-surface-pile forming operation.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a pile fabric cloth weaving machine in which piles are formed by changing the relative distance between the beating position of a reed and the cloth fell of the woven fabric, a pile forming apparatus, comprising:

a terry motion mechanism for changing the relative distance between the beating position of said reed and the cloth fell of said woven fabric;

a ball screw mechanism including a ball screw and a driven member threadedly engaging said ball screw, said drive member being translatable in a direction parallel to the longitudinal axis of said ball screw between a terry-zero position and a terry-available position and drivingly coupled to said terry motion mechanism to impart movement to said terry-motion mechanism corresponding to the displacement of said driven member to thereby change said relative distance with said terry motion mechanism; and a driving motor operatively connected to said ball screw for rotatively driving said ball screw reversibly.

2. A pile forming apparatus according to claim 1, wherein said ball screw comprises an output shaft of said driving motor.

3. In a pile fabric cloth weaving machine in which piles are formed by changing the relative distance between the beating position of a reed and the cloth fell of the woven fabric, a pile forming apparatus, comprising:

a terry motion mechanism disposed for contacting said woven fabric to displace said cloth fell for changing the relative distance between the beating position of said reed and the cloth fell of said woven fabric;

a ball screw mechanism including a ball screw and a driven member threadedly engaging with said ball screw, said driven member being translatable relative to said ball screw between a terry-zero position and a terry-available position and drivingly coupled to said terry motion mechanism to impart movement to said terry-motion mechanism corresponding to the displacement of said driven member to thereby change said relative distance with said terry motion mechanism; and a driving motor operatively connected to said ball screw for rotatively driving said ball screw reversibly.

4. In a pile fabric cloth weaving machine in which piles are formed by changing the relative distance between the beating position of a reed and the cloth fell of the woven fabric, a pile forming apparatus, comprising:

a terry motion mechanism for changing the relative distance between the beating position of said reed and the cloth fell of said woven fabric;

a ball screw mechanism including a ball screw and a driven member threadedly engaging with said ball screw, said driven member being translatable relative to said ball screw between a terry-zero position and a terry-available position and drivingly coupled to said terry motion mechanism to impart movement to said terry-motion mechanism corresponding to the displacement of said driven member to thereby change said relative distance with said terry motion mechanism, said ball screw being covered with flexible cover members that are extendable and retractable accompanying the displacement of said driven member; and a driving motor operatively connected to said ball screw for rotatively driving said ball screw reversibly.

5. In a pile fabric cloth weaving machine in which piles are formed by changing the relative distance between the beating position of a reed and the cloth fell of the woven fabric, a pile forming apparatus, comprising:

a terry motion mechanism for changing the relative distance between the beating position of said reed and the cloth fell of said woven fabric;

a ball screw mechanism including a ball screw and a driven member threadedly engaging with said ball screw, said driven member including an assembly of internally threaded nuts fitted onto said ball screw so as to linearly move along said ball screw and being translatable relative to said ball screw between a terry-zero position and a terry-available position and drivingly coupled to said terry motion mechanism to impart movement to said terry-motion mechanism corresponding to the displacement of said driven member to thereby change said relative distance with said terry motion mechanism; and a driving motor operatively connected to said ball screw for rotatively driving said ball screw reversibly.

6. A pile forming apparatus according to claim 5, wherein said nut assembly includes a pair of nuts urged toward each other.

7. A pile forming apparatus according to claim 6, further comprising a box-like casing for accommodating therein said ball screw mechanism, wherein said driving motor is disposed outside said casing with an output shaft thereof extending into said casing through one of two opposite walls of said casing and operatively connected to said ball screw supported by the other of said opposite walls, and wherein a flexible cover susceptible of contraction and expansion accompanying linear motion of said nut assembly is disposed between each of said two opposite walls of said casing and the corresponding proximate end of said nut assembly.

8. A pile forming apparatus according to claim 6, wherein the weaving machine comprises a surface roller, said terry motion mechanism being in association with said surface roller to cause said surface roller to be exchangeably indexed to a woven fabric forming position for a fast pick operation phase, a first woven cloth path shift position at which terry is made available for a first loose pick operation phase, and a second woven cloth path shift position at which terry is available for a second loose pick operation.

9. A pile forming apparatus according to claim 8, wherein said ball screw is rotatably supported by bearing means mounted in said two opposite walls.

10. A pile forming apparatus according to claim 8, wherein said driving motor is a servo motor, said apparatus further comprising a control computer for controlling said servo motor in accordance with a predetermined pile forming pattern.

11. A pile forming apparatus according to claim 8, wherein said nut assembly is provided with a slide member adapted to move linearly in unison with said nut assembly, and wherein said casing is provided with a channel-like guide member for guiding the linear movement of said slide member.

12. A pile forming apparatus according to claim 11, wherein rollers are provided within said channel-like guide member.

13. A pile forming apparatus according to claim 8, wherein said terry motion mechanism is comprised of a rotatably supported expansion bar disposed below the woven fabric; said ball screw mechanism includes a displacement direction switching lever supported rotatably in said casing and having bifurcated first and second arms, said first arm being operatively connected at a lower end thereof to a link which is supported by one of said pair of nuts: and an intermediate lever is provided between said second arm and a lower end of said expansion bar with first and second rods being interposed therebetween, respectively.

14. A pile forming apparatus according to claim 13, further comprising a tension roller for adjusting tension applied to pile-destined warps, said intermediate lever being configured in the form of a trifurcated lever having a first arm operatively connected to said tension roller, a second arm coupled to a lower end portion of said expansion bar through said second rod, and a third arm operatively connected to said second arm of said displacement direction switching lever through said first rod.

15. A pile forming apparatus according to claim 7, wherein said terry motion mechanism is comprised of an expansion bar disposed below said woven fabric and supported rotatably, said ball screw mechanism includes a displacement direction switching lever having a first arm and supported rotatably in said casing by a supporting shaft, said supporting shaft having one end portion extending outwardly through a wall of said casing and having another arm, supported on said extended one end portion of said supporting shaft, said first arm being operatively connected at a lower end thereof to a link which is supported by one of said pair of nuts; and wherein an intermediate lever is provided between said another arm and a lower end of said expansion bar with interposition of first and second rods, respectively.

16. A pile forming apparatus according to claim 5, wherein said pair of driven nuts are fixedly mounted at both end portions of said expansion bar so that said expansion bar is moved linearly when said ball screw is rotated forwardly or backwardly.

17. A method for forming piles by using a pile fabric cloth weaving machine in which piles are formed by changing the relative distance between the beating position of a reed and the cloth fell of the woven fabric, the pile forming apparatus comprising:

a terry motion mechanism for changing the relative distance between the beating position of said reed and the cloth fell of said woven fabric;

a ball screw mechanism including a ball screw and a driven member threadedly engaging with said ball screw, said driven member being translatable relative to said ball screw between a terry-zero position and a terry-available position and drivingly coupled to said terry motion mechanism to impart movement to said terry-motion mechanism corresponding to the displacement of said driven member to thereby change said relative distance with said terry motion mechanism; and a driving motor operatively connected to said ball screw for rotatively driving said ball screw reversibly;

said method being characterized in that an amount of terry in a second loose pick operation phase is so selected that it is greater than that in a first loose pick operation phase when piles are formed only on one fabric surface.

* * * * *

UNITED STATES PATENT AND TRADEMARK OFFICE

CERTIFICATE OF CORRECTION

PATENT NO. : 5,518,037
DATED : May 21, 1996
INVENTOR(S) : N. Takahashi et al

It is certified that error appears in the above-indentified patent and that said Letters Patent is hereby corrected as shown below:

On the title page item [57]
In the Abstract, line 2, after "asssuring insert --a--; line 11, after before "displace" insert --thereby.

Column 2, line 8, after "only" change "to" to --on--.

Column 3, line 15, change "distance" to --distances--.

Column 5, line 5, "screw-wise" should read --screwwise--; line 10, "screw-wise" should read --screwwise--; line 13, "screw-wise" should read --screwwise--; line 16, after "computer" insert comma --,--.

Column 6, line 56, "01, 02 and 03" should read --θ1, θ2 and θ3--; line 57 "01, 02 and 03" should read --θ1, θ2 and θ3--; line 63, "01," should read --θ1--, line 65, "02," should read --θ2,--.

UNITED STATES PATENT AND TRADEMARK OFFICE

CERTIFICATE OF CORRECTION

PATENT NO. : 5,518,037

DATED : May 21, 1996 Page 2 of 2

INVENTOR(S) : N. Takahashi et al

It is certified that error appears in the above-indentified patent and that said Letters Patent is hereby corrected as shown below:

Column 7, line 1, "03," should read --θ3,--; line 10, "01." should read --θ1.--; line 17 "02." should read --θ2.--; line 20 "03." should read --θ3.--; line 55, "T0" should read --$T_p$--.

Column 11, line 57, after "nuts" change colon to semicolon --;--.

Signed and Sealed this

Nineteenth Day of November, 1996

*Attest:*

*Attesting Officer*

BRUCE LEHMAN

*Commissioner of Patents and Trademarks*